US009354541B2

(12) United States Patent
Hasegawa et al.

(10) Patent No.: US 9,354,541 B2
(45) Date of Patent: May 31, 2016

(54) IMAGE FORMING APPARATUS AND EXPOSURE POSITION ADJUSTING METHOD

(71) Applicant: Konica Minolta, Inc., Chiyoda-ku, Tokyo (JP)

(72) Inventors: Ryo Hasegawa, Hachioji (JP); Katsuyuki Hirata, Toyokawa (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/671,378

(22) Filed: Mar. 27, 2015

(65) Prior Publication Data

US 2015/0277270 A1 Oct. 1, 2015

(30) Foreign Application Priority Data

Mar. 31, 2014 (JP) ..... 2014-072437

(51) Int. Cl.
*B41J 2/44* (2006.01)
*G03G 15/043* (2006.01)

(52) U.S. Cl.
CPC ..... *G03G 15/043* (2013.01)

(58) Field of Classification Search
USPC ..... 347/229, 234, 235, 240, 248–250, 251
See application file for complete search history.

(56) References Cited

U.S. PATENT DOCUMENTS 5,844,591 A * 12/1998 Takamatsu et al. ..... 347/235
6,831,672 B2 * 12/2004 Maeda ..... 347/234

FOREIGN PATENT DOCUMENTS

JP H10062705 A 3/1998
JP 2007133056 A 5/2007
JP 2010197072 A 9/2010

* cited by examiner

*Primary Examiner* — Alejandro Valencia
(74) *Attorney, Agent, or Firm* — Cantor Colburn LLP

(57) ABSTRACT

According to an image forming apparatus and an exposure position adjusting method of one aspect of the present invention, an exposure section scans a plurality of light beams to form a plurality of electrostatic latent images periodically along a main-scanning direction of the photoreceptor at a predetermined pitch in a sub-scanning direction of the photoreceptor. Next, a surface potential detecting section detects electric potentials of the plurality of electrostatic latent images formed on the surface of the photoreceptor, along the main-scanning direction. Furthermore, a controller calculates exposure timings by the plurality of light beams in the exposure section on the basis of a detection result by the surface potential detecting section.

2 Claims, 11 Drawing Sheets

IMAGE FORMING APPARATUS AND EXPOSURE POSITION ADJUSTING METHOD

CROSS REFERENCE TO RELATED APPLICATIONS

The present invention claims priority under 35 U.S.C. §119 to Japanese Application No. 2014-072437 filed Mar. 31, 2014, the entire content of which is incorporated herein by reference.

BACKGROUND OF THE INVENTION

1. Field of the Invention

The present invention relates to a multi-beam image forming apparatus and an exposure position adjusting method, and in particular, to a technique of adjusting beam pitches of plural light beams in a main-scanning direction.

2. Description of the Related Art

Conventionally, in response to a demand for an increase in the speed of image output, there has been proposed an image forming apparatus including a multi-beam exposure section that scans plural light beams over a photoreceptor at the same time. In order to obtain a high-quality image using such an image forming apparatus, it is important to appropriately adjust beam pitches (intervals) of the plural light beams scanned over the photoreceptor in the main-scanning direction and the sub-scanning direction.

In general, in the case of the image forming apparatus, rough adjustment (without outputting a pattern image for evaluation) is performed for the multi-beam exposure section alone. Thereafter, the multi-beam exposure section is assembled to the actual apparatus, and pattern images for evaluation are output by varying exposure-start timings for each of the light sources. Then, an adjustment operator visually evaluates the pattern images for evaluation to make fine adjustment (adjustment involving effects of the photoreceptor or other units).

For example, as for adjustment of the beam pitches in the sub-scanning direction, there is disclosed a technique of outputting an image pattern for evaluation to detect a slight change in beam pitches of plural light beams in the sub-scanning direction (see, for example, Patent Literature 1).

Furthermore, there is disclosed an evaluation chart for easily checking a positional shift of irradiation of plural light beams in the sub-scanning direction (see, for example, Patent Literature 2).

Moreover, there is disclosed an evaluation chart with which displacement of light beam pitches in the sub-scanning direction can be detected in a highly precise manner (see, for example, Patent Literature 3). The evaluation chart includes an image evaluation pattern in which plural image patterns formed by a combination of plural different light beams are arranged so as to be adjacent to each other in the main-scanning direction, the image pattern being formed by repeating n dot lines (n≥2), which are formed in the main-scanning direction, in the sub-scanning direction at a period of an integral multiple of the number of light beams.

RELATED ART DOCUMENTS

Patent Literature

Patent Literature 1: Japanese Patent Laid-Open Publication No. 2007-133056

Patent Literature 2: Japanese Patent Laid-Open Publication No. 2010-197072

Patent Literature 3: Japanese Patent Laid-Open Publication No. H10-62705

DISCLOSURE OF THE INVENTION

Problems to be Solved by the Invention

In the case of conventional adjustment using image output, an adjustment operator visually checks the amount of shift on an image pattern for evaluation which allows visual check of pitch shifts in the main-scanning direction, and then, inputs values for adjustment into an image forming apparatus on the basis of the amount of shift, thereby performing the adjustment. Thus, the results of adjustment are largely affected by differences in skill of the operator (for example, yellow is less visible than other colors, and hence, blue light is irradiated to the image pattern for evaluation, thereby performing visual check), so that inappropriate images may be formed due to variations in adjustment.

Furthermore, adjustment and checking, which are performed after an image pattern for evaluation is output, are repeated until there are no more pitch shifts, which means that the adjustment operations are performed for plural times. Thus, time required for adjustment tends to be longer, and the number of sheets on which the image patterns for evaluation are output increases, which leads to an increase in cost. In the case where a service operator performs these adjustment and checking described above after the image forming apparatus is shipped, cost of the operations performed by the service operator is necessary.

Moreover, evaluation is performed by visually checking the line widths (the way in which line images constituting the image pattern for evaluation are overlapped with each other (black line) or spaced apart from each other (white line)) in the image pattern for evaluation output on the sheet. Thus, operations cannot be correctly done due to an effect of image streaks (black streak or white streak).

FIG. 11 shows an example of an image pattern for evaluation obtained by exposing and scanning light beams emitted from plural light sources over the photoreceptor. The image pattern for evaluation includes plural line images, for example, arranged at predetermined pitches in the sub-scanning direction of the photoreceptor and periodically in the main-scanning direction for each of the plural light beams. The example in FIG. 11 illustrates image patterns 301 to 303 for evaluation, each of which is obtained by exposing light using an exposure section having eight light sources (also referred to as "LD1" to "LD8") under three different conditions A to C. Here, descriptions will be made by focusing on line images by the LD1 and line images by the LD8.

Intervals between the line image by the LD1 and the line image by the LD8 will be described below for each of the conditions A to C.

Under the condition A, a timing of exposure by the LD8 (hereinafter, referred to as an "exposure timing") is earlier than that by the LD1. Thus, an overlapping portion 301D appears between the line image by the LD8 and the line image by the LD1 located on the left thereof, and a spaced portion 301A appears between the line image by the LD8 and the line image by the LD1 located on the right thereof.

Under the condition B, the exposure timing of the LD8 is appropriate. There is no overlapping portion or spaced portion between the line image by the LD8 and the line images by the LD1 located on the left and right thereof. Moreover, the line image by the LD8 and the line images by the LD1 are spaced at an appropriate interval.

Under the condition C, the exposure timing of the LD8 is later than that of the LD1. Thus, a spaced portion 303A appears between the line image by the LD8 and the line image by the LD1 on the left thereof, and an overlapping portion 303D appears between the line image by the LD8 and the line image by the LD1 on the right thereof.

In the example illustrated in FIG. 11, under the condition B, beam pitches of light beams are aligned in the main-scanning direction. As described above, it is possible to determine whether the exposure timing of each light source is appropriate by checking the degree of overlapping or degree of spacing between line images in the image pattern for evaluation.

However, as illustrated in FIG. 12A and FIG. 12B, if there is a process noise such as a black streak 304B at a portion (border between line images repeated) desired to be determined, which is indicated by the arrow, it is not possible to correctly make determination.

All of the techniques according to Patent Literatures 1 to 3 described above relate to formation of an evaluation chart for determining whether beam pitches in the sub-scanning direction are appropriate, and do not relate to a technique of automatically correcting beam pitches. Furthermore, even if the evaluation chart is used, the shift of beam pitches cannot be purely determined or adjusted due to the effect of process noises or the like occurring after exposure. Thus, even if the beam pitches are adjusted on the basis of the evaluation chart, there is a possibility that an inappropriate image occurs due to variations in processes after the adjustment.

Due to these circumstances, there has been a demand for techniques that can appropriately adjust beam pitches of plural light beams in the main-scanning direction without receiving the effect of process noises or the like after exposure.

SUMMARY OF THE INVENTION

According to an image forming apparatus and an exposure position adjusting method of one aspect of the present invention, an exposure section scans plural light beams to form plural electrostatic latent images arranged at a predetermined pitch in a sub-scanning direction of the photoreceptor and in a periodical manner along a main-scanning direction of the photoreceptor. Next, a surface potential detecting section detects, along the main-scanning direction, electric potentials of the plural electrostatic latent images formed on the surface of the photoreceptor. Furthermore, a controller calculates an exposure timing for the plural light beams emitted from the exposure section on the basis of a detection result obtained by the surface potential detecting section.

With the configuration described above, the exposure timing for the plural light beams is adjusted on the basis of the electric potentials, before development, of the electrostatic latent images formed by the plural light beams and formed in the main-scanning direction of the photoreceptor.

DESCRIPTION OF THE PREFERRED EMBODIMENTS

Hereinbelow, a mode for carrying out the present invention will be described in detail with reference to the drawings. Note that, in the following descriptions or drawings, the same elements or the elements having the same functions are denoted as the same reference signs, and redundant explanation thereof will not be repeated.

1. First Embodiment

[Example of Configuration of Image Forming Apparatus]

First, an outline of an image forming apparatus according to an embodiment of the present invention will be described with reference to FIG. 1.

Figure 1:
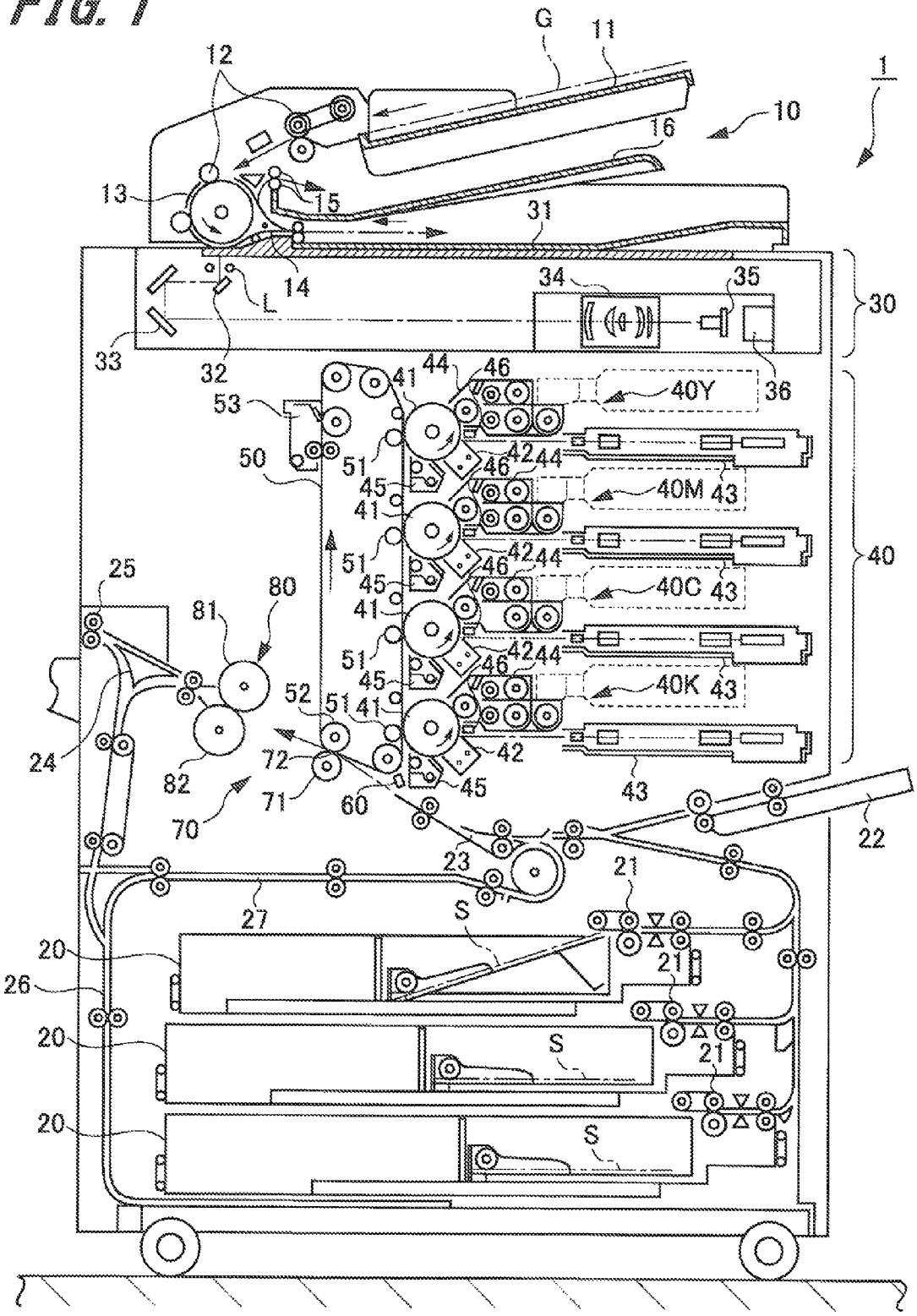
FIG. 1 is an overall configuration view illustrating an image forming apparatus according to a first embodiment of the present invention.

FIG. 1 is an overall configuration view illustrating the image forming apparatus according to an embodiment of the present invention.

As illustrated in FIG. 1, the image forming apparatus 1 forms an image on a sheet in an electrophotography manner, and is a tandem-type color image forming apparatus in which toners with four colors, yellow (Y), magenta (M), cyan (C), and black (Bk), are overlapped. The image forming apparatus 1 includes a document conveying section 10, a sheet accommodating section 20, an image reading section 30, an image forming section 40, an intermediate transfer belt 50, a secondary transfer section 70, and a fixing section 80.

The document conveying section 10 includes a document feeding table 11 on which a document G is set, plural rollers 12, a conveying drum 13, a conveying guide 14, a document ejecting roller 15, and a document receiving tray 16. The document G set on the document feeding table 11 is conveyed by the plural rollers 12 and the conveying drum 13 to a reading position on the image reading section 30 on a sheet-by-sheet basis. The conveying guide 14 and the document ejecting roller 15 eject the document G, conveyed by the plural rollers 12 and the conveying drum 13, to the document receiving tray 16.

The image reading section 30 reads an image of the document G conveyed by the document conveying section 10 or an image of a document placed on a document station 31, and generates image data. More specifically, an image of the document G is irradiated with a lamp L. The light reflected from the document G is guided to the first mirror unit 32, the second mirror unit 33, and the lens unit 34 in this order, and an image thereof is formed on a light receiving surface of the imaging element 35. The imaging element 35 performs photoelectric conversion to the incident light, and outputs a predetermined image signal. The image signal output is subjected to A/D conversion, so that image data is generated.

In addition, the image reading section 30 includes an image-reading controlling section 36. The image-reading controlling section 36 applies shading correction, dither processing, compression, or other processing to the image data generated through the A/D conversion, and stores the processed data in a RAM 103 (see FIG. 2). Note that the image data is not limited to data output from the image reading section 30, and may be data received from an external device connected to the image forming apparatus 1 such as a personal computer and another image forming apparatus.

The sheet accommodating section 20 is disposed in the lower portion of the apparatus body, and two or more sheet accommodating sections 20 may be provided depending on sizes or types of the sheet. The sheet is fed by a sheet feeding section 21 to reach a conveying section 23, and then, the conveying section 23 conveys the sheet to the secondary transfer section 70 having a transfer position. In other words, the conveying section 23 functions to convey the sheet fed from the sheet feeding section 21 to the secondary transfer section 70, and forms a conveying path for conveying the sheet. In addition, a manual feed section 22 is provided in the vicinity of the sheet accommodating section 20. A special paper such as a sheet having a size that the sheet accommodating section 20 does not accommodates, a tagged sheet having a tag, and an OHP sheet is sent from the manual feed section 22 to the transfer position. In FIG. 1, the reference sign S is attached to a sheet to be fed by the sheet feeding section 21.

The image forming section 40 and the intermediate transfer belt 50 are disposed between the image reading section 30 and the sheet accommodating section 20. The image forming section 40 includes four image forming units 40Y, 40M, 40C, and 40K to form a toner image of yellow (Y), a toner image of magenta (M), a toner image of cyan (C), and a toner image of black (Bk), respectively.

The first image forming unit 40Y forms a toner image of yellow, and the second image forming unit 40M forms a toner image of magenta. In addition, the third image forming unit 40C forms a toner image of cyan, and the fourth image forming unit 40K forms a toner image of black. These four image forming units 40Y, 40M, 40C, and 40K have the same configuration, and hence, the first image forming unit 40Y will be mainly described here.

The first image forming unit 40Y includes a drum-shaped photoreceptor 41, and further includes a charging section 42, an exposure section 43, a developing section 44, and a cleaning section 45, each of which is arranged around the photoreceptor 41. The photoreceptor 41 is rotated by a driving motor, not illustrated. The charging section 42 gives an electric charge to the photoreceptor 41 to uniformly charge the surface of the photoreceptor 41. The exposure section 43 performs exposure and scanning on the surface of the photoreceptor 41 on the basis of the image data created by the image reading section 30, the image data transmitted from an external device, or other data, to form a spot-shaped electrostatic latent image on the photoreceptor 41.

The exposure section 43 includes a deflection optical system, and plural light sources (not illustrated) spaced apart by a certain distance in the main-scanning direction and the sub-scanning direction. Each of the light sources emits a light beam according to pulse current input from a pulse generating section (not illustrated) on the basis of the image data. The light beams emitted from the plural light sources are deflected at one time toward a targeted direction by the deflection optical system, not illustrated. The deflection optical system is configured to include, for example: a collimator lens that converts the incident light beams into parallel light beams; a prism that converts the plural light beams so as to have predetermined beam pitches; a collimator lens that collects and condenses the incident light beams; a polygon mirror that reflects the light beams incident from the collimator lens; and a scanning lens that inputs the light beams incident from the polygon mirror onto the surface of the photoreceptor 41. The exposure section 43 simultaneously deflects the plural light beams spaced apart by a certain distance in the main-scanning direction and the sub-scanning direction in accordance with an instruction of the CPU 101, which will be described later, to periodically scan the surface of the photoreceptor 41 in the main-scanning direction.

The developing section 44 causes yellow toner to adhere to the electrostatic latent image formed on the photoreceptor 41 using two-component developer including toner and carrier, for example. With such operation, a toner image of yellow is formed on the surface of the photoreceptor 41.

A surface potential sensor 46 that detects electric potentials on the surface of the photoreceptor 41 is disposed between the exposure position (writing position) of the photoreceptor 41 and the developing section 44. A so-called image stabilization control, in which control conditions for each process of forming images are varied, is performed appropriately according to the detection results of the surface potential sensor 46 and detection results of a toner adhesion amount detecting sensor 60, which will be described later. In addition, the surface potential sensor 46 is used to adjust the exposure timing of the exposure section 43, which will be described later.

It should be noted that the developing section 44 of the second image forming unit 40M causes magenta toner to adhere to the photoreceptor 41, and the developing section 44 of the third image forming unit 40C causes cyan toner to adhere to the photoreceptor 41. Furthermore, the developing section 44 of the fourth image forming unit 40K causes black toner to adhere to the photoreceptor 41.

The toner image formed on the photoreceptor 41 is transferred to the intermediate transfer belt 50. The intermediate transfer belt 50 is formed endlessly, and is wound around plural rollers. The intermediate transfer belt 50 is driven to rotate by a driving motor, not illustrated, in a direction opposite to the rotational (movement) direction of the photoreceptor 41.

The cleaning section 45 removes toner remaining on the surface of the photoreceptor 41 after the toner image is transferred to the intermediate transfer belt 50.

Four primary transfer sections 51 are provided on the intermediate transfer belt 50 in positions facing the respective photoreceptor 41 of the four image forming units 40Y, 40M, 40C, and 40K. The primary transfer section 51 applies a voltage having a polarity opposite to that of toner, to the intermediate transfer belt 50 to primarily transfer the toner image formed on the photoreceptor 41 to the intermediate transfer belt 50.

Then, with the intermediate transfer belt 50 being driven to rotate, the toner images formed by the four image forming units 40Y, 40M, 40C, and 40K are sequentially transferred onto the surface of the intermediate transfer belt 50. Thereby, toner images with yellow, magenta, cyan, and black are overlapped on the intermediate transfer belt 50, whereby a color toner image is formed.

The toner adhesion amount detecting sensor 60 is provided in the vicinity of the intermediate transfer belt 50 and on the downstream of the four photoreceptors 41 in the sheet conveying direction. The toner adhesion amount detecting sensor 60 detects the amount of toner adhering to the intermediate transfer belt 50.

In addition, a belt cleaning device 53 is provided so as to face the intermediate transfer belt 50. The belt cleaning device 53 cleans the surface of the intermediate transfer belt 50 that has finished transferring the toner image to the sheet.

The secondary transfer section 70 is provided in the vicinity of the intermediate transfer belt 50 and on the downstream of the conveying section 23 in the sheet conveying direction. The secondary transfer section 70 secondarily transfers, to a sheet, the toner image formed on the outer peripheral surface of the intermediate transfer belt 50.

The secondary transfer section 70 includes a secondary transfer roller 71. The secondary transfer roller 71 is pressure contacted with an opposing roller 52 with the intermediate transfer belt 50 sandwiched therebetween. A portion where the secondary transfer roller 71 and the intermediate transfer belt 50 contact with each other serves as a secondary transfer nip portion 72. The secondary transfer nip portion 72 is a transfer position where the toner image formed on the outer peripheral surface of the intermediate transfer belt 50 is transferred to the sheet S.

The fixing section 80 is provided on the sheet-ejecting side of the secondary transfer section 70. The fixing section 80 presses and heats the sheet to fix the transferred toner image on the sheet. The fixing section 80 includes, for example, a fixing upper roller 81 and a fixing lower roller 82, which are paired fixing members. The fixing upper roller 81 and the fixing lower roller 82 are arranged in a state where they are press contacted with each other, and a fixing nip portion, which serves as a press contacted portion, is formed at a position where the fixing upper roller 81 and the fixing lower roller 82 come into contact with each other.

A heating section is provided within the fixing upper roller 81. With radiant heat from the heating section, the outer peripheral portion of the fixing upper roller 81 is heated. Then, heat from the fixing upper roller 81 is transferred to the sheet, whereby the toner image on the sheet is heated and fixed thereon.

The sheet is conveyed so that the fixing upper roller 81 faces a surface of the sheet (surface on which the toner image is to be fixed) on which the toner image is transferred by the secondary transfer section 70, and passes through the fixing nip portion. Thus, the sheet passing through the fixing nip portion is pressed by the fixing upper roller 81 and the fixing lower roller 82, and is heated with heat from the fixing upper roller 81.

A switching gate 24 is disposed on the downstream of the fixing section 80 in the sheet conveying direction. The switching gate 24 switches paths for conveying the sheet having passed through the fixing section 80. More specifically, the switching gate 24 makes the sheet move straight ahead if a sheet is ejected with the image-formed side facing up in the case of one-side image formation. With such operation, the sheet is ejected by paired sheet ejecting rollers 25. Furthermore, the switching gate 24 guides the sheet downward if the sheet is ejected with the image-formed side facing down in the case of one-side image formation, or if both-sides image formation is performed.

In the case where the sheet is ejected with the image-formed side facing down, the switching gate 24 guides the sheet downward, and then, a sheet reversing-and-conveying section 26 reverses the sheet from side to side to convey the sheet upward. With such operation, the sheet reversed from side to side and having the image-formed side face down is ejected by the paired sheet ejecting rollers 25.

In the case where images are formed on both sides of the sheet, the switching gate 24 guides the sheet downward, then the sheet reversing-and-conveying section 26 reverses the sheet from side to side, and a re-feeding path 27 sends the sheet to the transfer position of the secondary transfer section 70 again.

It may be possible that a post-processing device that folds the sheet, staples the sheet, or performs other processes is disposed on the downstream side of the paired sheet ejecting rollers 25.

[Configuration of Control System of Image Forming Apparatus]

Next, a control system of the image forming apparatus 1 will be described with reference to FIG. 2.

Figure 2:
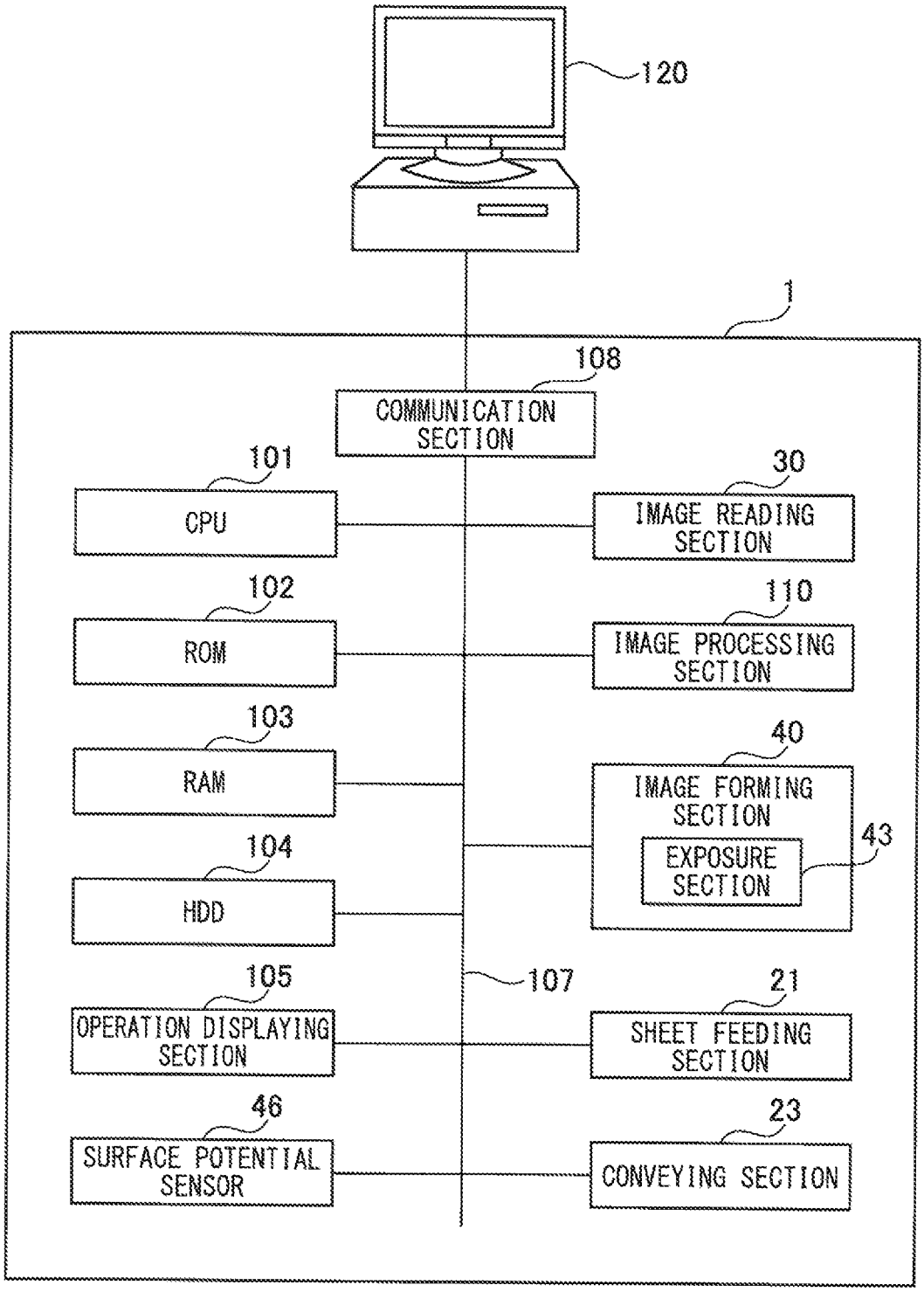
FIG. 2 is a block diagram illustrating a hardware configuration of each section of the image forming apparatus according to the first embodiment.

FIG. 2 is a block diagram illustrating the control system of the image forming apparatus 1.

As illustrated in FIG. 2, the image forming apparatus 1 includes, for example, a central processing unit (CPU) 101, a read only memory (ROM) 102 for storing, for example, a program that the CPU 101 executes, and a random access memory (RAM) 103 used as a work area of the CPU 101. In addition, the image forming apparatus 1 includes a hard disk drive (HDD) 104 serving as a large-capacity storage device, and an operation displaying section 105. Note that, for example, a programmable ROM that is electrically erasable is used as the ROM 102.

The CPU 101 is an example of a controller, and is connected with the ROM 102, the RAM 103, the HDD 104, and the operation displaying section 105 through a system bus 107 to control the entire apparatus. In addition, the CPU 101 is connected with the image reading section 30, an image processing section 110, the image forming section 40, the sheet feeding section 21, and the conveying section 23 through the system bus 107.

The HDD 104 stores image data on an image of a document obtained through reading in the image reading section 30, and stores image data or other data that has been already output. The operation displaying section 105 is a touch panel formed by a display such as a liquid crystal display device (LCD) and an organic electro luminescence display (organic ELD). The operation displaying section 105 displays, for example, information concerning an instruction menu for a user and image data acquired. In addition, the operation displaying section 105 includes plural keys, and receives input of data such as various instructions, letters, and numbers through key operations performed by a user, thereby outputting the input signal to the CPU 101.

The image data created by the image reading section 30 or image data transmitted from a personal computer (PC) 120 serving as one example of an external device connected to the image forming apparatus 1 is transmitted to the image processing section 110, and is subjected to image processing. The image processing section 110 performs image processing, including shading correction, image density adjustment, and image compression, on the received image data as necessary.

In the image forming section 40, the image data subjected to the image processing by the image processing section 110 is received; the exposure section 43 performs exposure to the photoreceptor 41 on the basis of the image data; and the developing section 44 develops, whereby an image is formed on the sheet S.

The surface potential sensor 46 (an example of a surface potential detecting section) detects electric potentials of electrostatic latent images formed on the surface of the photoreceptor 41 in the main-scanning direction, and outputs the detection results to the CPU 101. The surface potential sensor 46 detects planarly respective electrical potentials of plural electrostatic latent images each having a reading width of several millimeters per side in the main-scanning direction and the sub-scanning direction. The CPU 101 adjusts exposure timings of the plural light beams in the exposure section 43, on the basis of detection results of the electric potentials of each of the plural electrostatic latent images output from the surface potential sensor 46. With such operation, the exposure position of each of the plural light beams is adjusted in the main-scanning direction, so that beam pitches can be adjusted. The exposure timing is defined, for example, on the basis of exposure starting timing and exposure time. In the example, at the time of adjusting the beam pitches, the exposure time is set to be constant.

A communication section 108 receives job information transmitted, for example, from the PC 120 serving as an external information processing device through a communication line. Then, the communication section 108 transmits the received job information to the CPU 101 through the system bus 107.

It should be noted that, in the present embodiment, an example in which a personal computer is applied as the external device has been described. However, the external device is not limited to this. It may be possible to employ, for example, a facsimile device or other various devices as the external device.

[Adjustment of Exposure Timing of Light Beam]

The image forming apparatus 1 described above performs a process of adjusting exposure timings of plural light beams in the main-scanning direction. The process of adjusting the exposure timings includes: forming a pattern image for adjusting exposure positions on the photoreceptor 41; detecting, by the surface potential sensor 46, an electric potential of an electrostatic latent image constituting the pattern image for adjusting exposure positions; and reflecting the detection results to the exposure timings (exposure starting timings).

Figure 3:
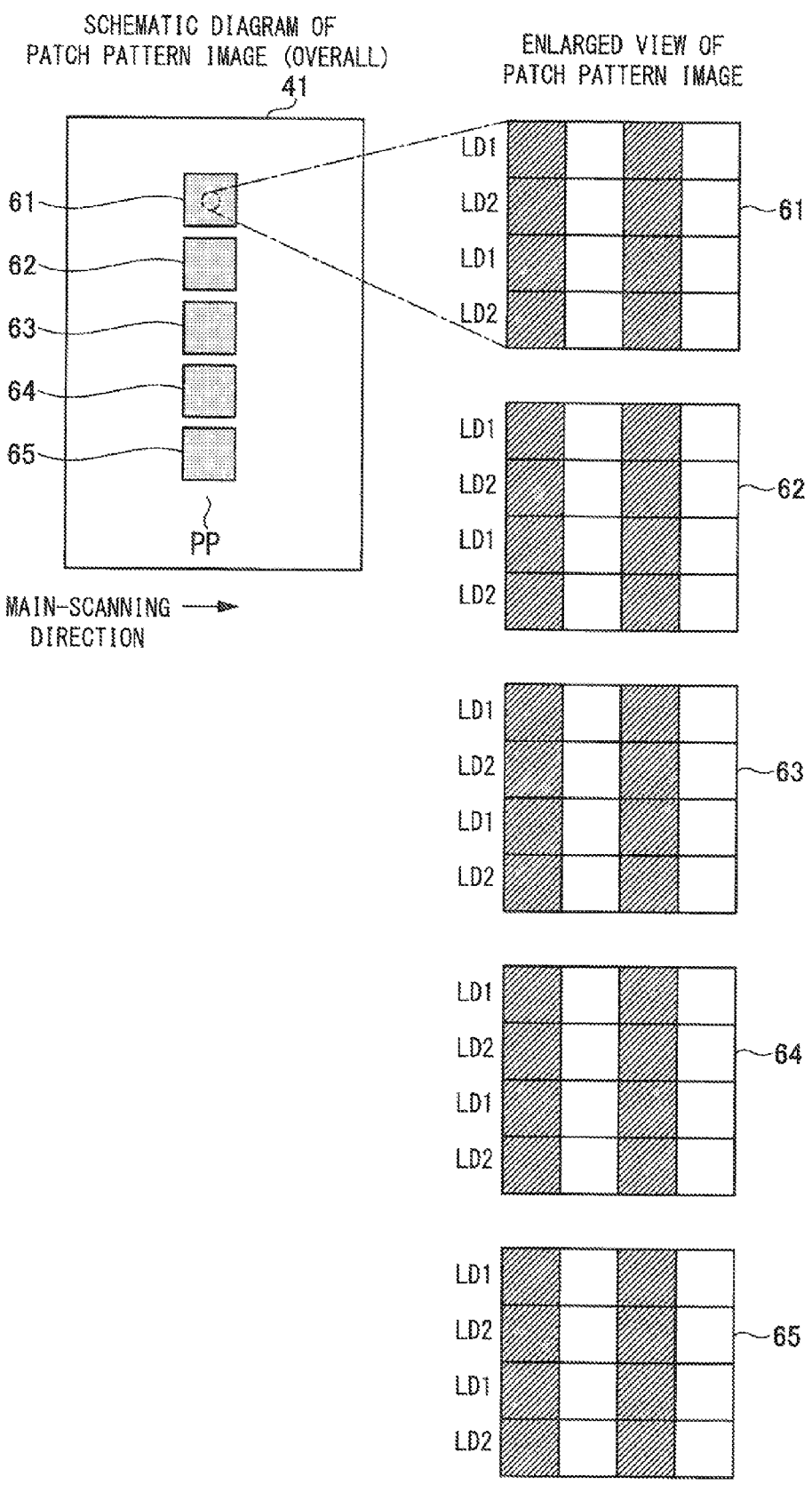
FIG. 3 is an explanatory view illustrating a patch pattern image according to the first embodiment.

FIG. 3 illustrates patch pattern images according to the first embodiment.

A pattern image for adjusting exposure positions is formed on the surface of the photoreceptor 41 as a patch-like pattern image (hereinafter, referred to as a "patch pattern image") PP as illustrated in the left drawing of FIG. 3. In the example, five patches 61 to 65 are arranged in the sub-scanning direction perpendicular to the main-scanning direction. The patch pattern image PP is formed for each of the first to fourth image forming units 40Y, 40M, 40C, and 40K corresponding to colors of toner images.

The drawings on the right side in FIG. 3 are enlarged diagrams each partially illustrating the patch pattern image PP. Here, for the purpose of simplification, it is assumed that the exposure section 43 has two light sources spaced apart by a certain distance in the main-scanning direction as well as in the sub-scanning direction. Of the two light sources, the first light source is denoted as LD1, and the second light source is denoted as LD2. Hatched portions in the patches 61 to 65 indicate pixels to which exposure is performed, and blank portions indicate pixels to which no exposure is performed. All the patterns within each of the patches 61 to 65 are equal on the image data. Plural electrostatic latent images are periodically formed so as to be arranged at predetermined pitches in the sub-scanning direction of the photoreceptor 41 and in the main-scanning direction for each of the plural light beams on the basis of a pattern for adjusting exposure positions similar to the patch pattern image PP.

Figure 4:
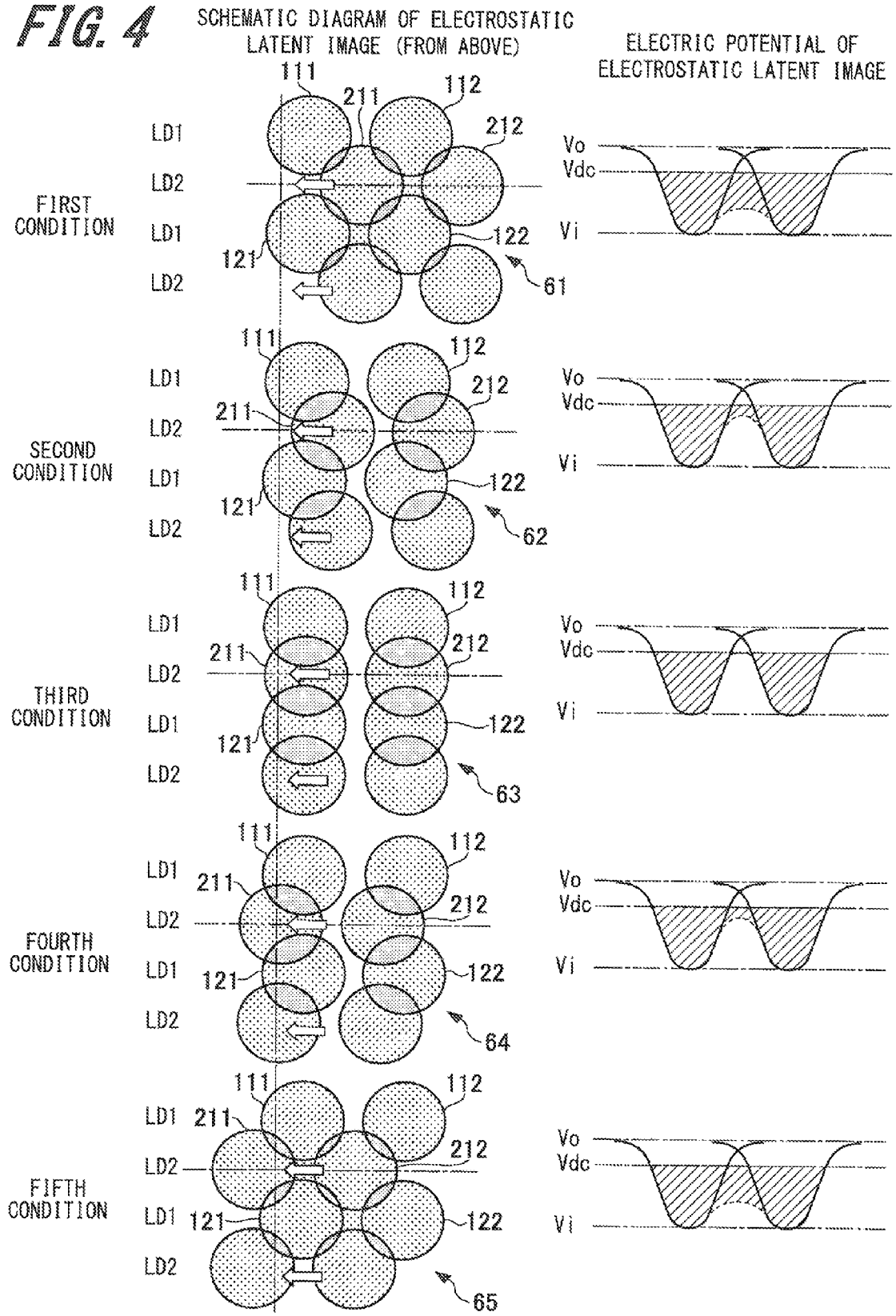
FIG. 4 is an explanatory view illustrating an example of positions of electrostatic latent images and electric potentials of the electrostatic latent images according to the first embodiment.

FIG. 4 illustrates an example of positions of electrostatic latent images and electric potentials of the electrostatic latent images according to the first embodiment.

Each drawing on the left side in FIG. 4 (schematic view when viewed from above) shows examples of electrostatic latent images formed by subjecting the photoreceptor 41 to exposures with various conditions for exposure timings, on the basis of the patch pattern image PP illustrated in FIG. 3. In the drawings, the arrows indicate a direction in which the positions of electrostatic latent images formed by the LD2 change as the conditions are varied from the first condition to the fifth condition. The main-scanning direction is a direction opposite to these arrows and runs from left to right. Furthermore, each drawing on the right side in FIG. 4 shows a distribution of electric potentials, detected by the surface potential sensor 46, of two electrostatic latent images 211 and 212 formed by the LD2 arranged in the main-scanning direction. Note that the electric potential Vo represents an electric potential in a state where the surface of the photoreceptor 41 is not subjected to exposure, the electric potential Vd represents a developer bias, and the electric potential Vi represents an electric potential after exposure. However, the electric potentials of the electrostatic latent image are not limited to those shown in the example.

In the examples illustrated in FIG. 4, in the case of the patch 61, the exposure timing for the LD2 is 10 steps later relative to that for the LD1 (first condition). One step represents a predetermined distance set in advance, and the number of steps represents the distance from a standard position to an exposure starting position (in other words, delay time or advance time from the standard exposure timing). Under the first condition, as illustrated in the left drawing in FIG. 4, a first-stage electrostatic latent image 112 and a second-stage electrostatic latent image 122 formed by the LD1 are located at equal distances from the electrostatic latent images 211 and 212 formed by the LD2. Thus, the electric potentials of the electrostatic latent images 211 and 212 formed by the LD2 strongly receive interference from the electric potentials of the electrostatic latent images 112, 122 formed by the LD1. If such interference of the electric potentials occurs, the electrostatic latent image 211 and the electrostatic latent image 212 adhere to each other, and electric field changes at the time of development, which leads to a deterioration in image quality.

Furthermore, in the case of the patch 62, the exposure timing for the LD2 is 5 steps later relative to that for the LD1 (second condition). Under the second condition, as illustrated in the left drawing in FIG. 4, the first-stage electrostatic latent image 112 and the second-stage electrostatic latent image 122 formed by the LD1 are located closer to a position located at equal distances from the electrostatic latent images 211 and 212 formed by the LD2. Thus, the electric potentials of the electrostatic latent images 211 and 212 formed by the LD2 receive interference from the electric potentials of the electrostatic latent images 112 and 122 formed by the LD1 although the interference is weak.

Furthermore, in the case of the patch 63, the exposure timing for the LD2 is 0 step, and is equal to that for the LD1 (third condition). Under the third condition, the first-stage electrostatic latent images 111 and 112 and the second-stage electrostatic latent images 121 and 122 formed by the LD1 positionally match the electrostatic latent images 211 and 212 formed by the LD2, respectively, in the sub-scanning direction. In such a state, the electric potentials of the electrostatic latent images 211 and 212 formed by the LD2 do not receive any interference from the electrostatic latent images 112 and 122 formed by the LD1 (and from the electrostatic latent images 111 and 121).

Furthermore, in the case of the patch 64, the exposure timing for the LD2 is 5 steps earlier relative to that for the LD1 (fourth condition). Under the fourth condition, as illustrated in the left drawing in FIG. 4, the first-stage electrostatic latent image 111 and the second-stage electrostatic latent image 121 formed by the LD1 are located closer to a position located at equal distances from the electrostatic latent images 211 and 212 formed by the LD2. Thus, the electric potentials of the electrostatic latent images 211 and 212 formed by the LD2 receive interference from the electric potentials of the electrostatic latent images 111 and 121 formed by the LD1 although the interference is weak.

In addition, in the case of the patch 65, the exposure timing for the LD2 is 10 steps earlier relative to that for the LD1 (fifth condition). Under the fifth condition, as illustrated in the left drawing in FIG. 4, the first-stage electrostatic latent image 111 and the second-stage electrostatic latent image 121 formed by the LD1 are located at equal distances from the electrostatic latent images 211 and 212 formed by the LD2. Thus, the electric potentials of the electrostatic latent images 211 and 212 formed by the LD2 strongly receive interference from the electric potentials of the electrostatic latent images 111 and 121 formed by the LD1.

Figure 5:
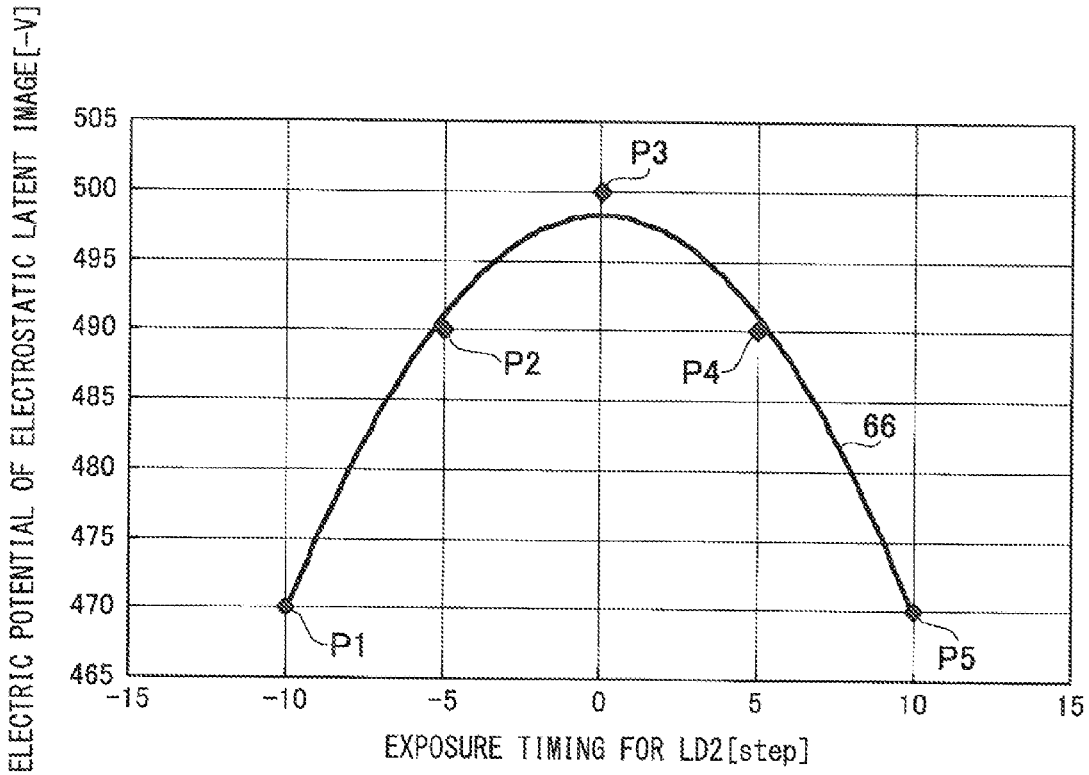
FIG. 5 is a graph showing an example of a relationship between exposure timings and electric potentials of electrostatic latent images according to the first embodiment.

FIG. 5 is a graph showing one example of a relationship between exposure timings for exposure and electric potentials of electrostatic latent images according to the first embodiment. The horizontal axis represents an exposure timing [step] for the LD2, and the vertical axis represents an electric potential [−V] of an electrostatic latent image. The electric potential of the electrostatic latent image on the vertical axis indicates a value obtained through integration of electric potentials of plural electrostatic latent images in the main-scanning direction. Measurement points P1 to P5 indicate electric potentials of the electrostatic latent images formed by the LD2 under the first condition to the fifth condition. A characteristic curve 66 corresponds to an approximate expression calculated on the basis of the measurement points P1 to P5 obtained under the first condition to the fifth condition, respectively.

Under a condition where an absolute value of the integral value of electric potentials of the electrostatic latent images is the maximum in the approximate expression (characteristic curve 66), the electric potential of the electrostatic latent image formed by a light beam from the light source (LD2 in FIG. 5) is the least affected by interference from electric potentials of other electrostatic latent images. In addition, if the interference between the electrostatic latent images is the minimum, the condition is the optimum exposure timing at which beam pitches (intervals) in the main-scanning direction are aligned between plural electrostatic latent images formed by a light beam to be measured (LD2) and plural electrostatic latent images formed by a light beam to be compared (LD1). As described above, the optimum exposure timing can be obtained on the basis of the condition where the absolute value of the integral value of electric potentials of the electrostatic latent images is the maximum in the approximate expression (characteristic curve 66).

It should be noted that, in the example illustrated in FIG. 5, the third condition provides the optimum exposure timing. However, there is a possibility that the exposure timing is the optimum under other conditions. Furthermore, there is a possibility that the absolute value of the integral value of electric potentials of electrostatic latent image is the maximum, for example, at a time midway between different two exposure timings. In such a case, the exposure timing at which the absolute value of the integral value of electric potentials of electrostatic latent images is the maximum is calculated by performing interpolation, for example, using electric potentials of electrostatic latent images at two exposure timings approximate to the maximum value of the absolute value of the integral value.

[Operation of Image Forming Apparatus]

Below, operations performed by the image forming apparatus 1 will be described.

Figure 6:
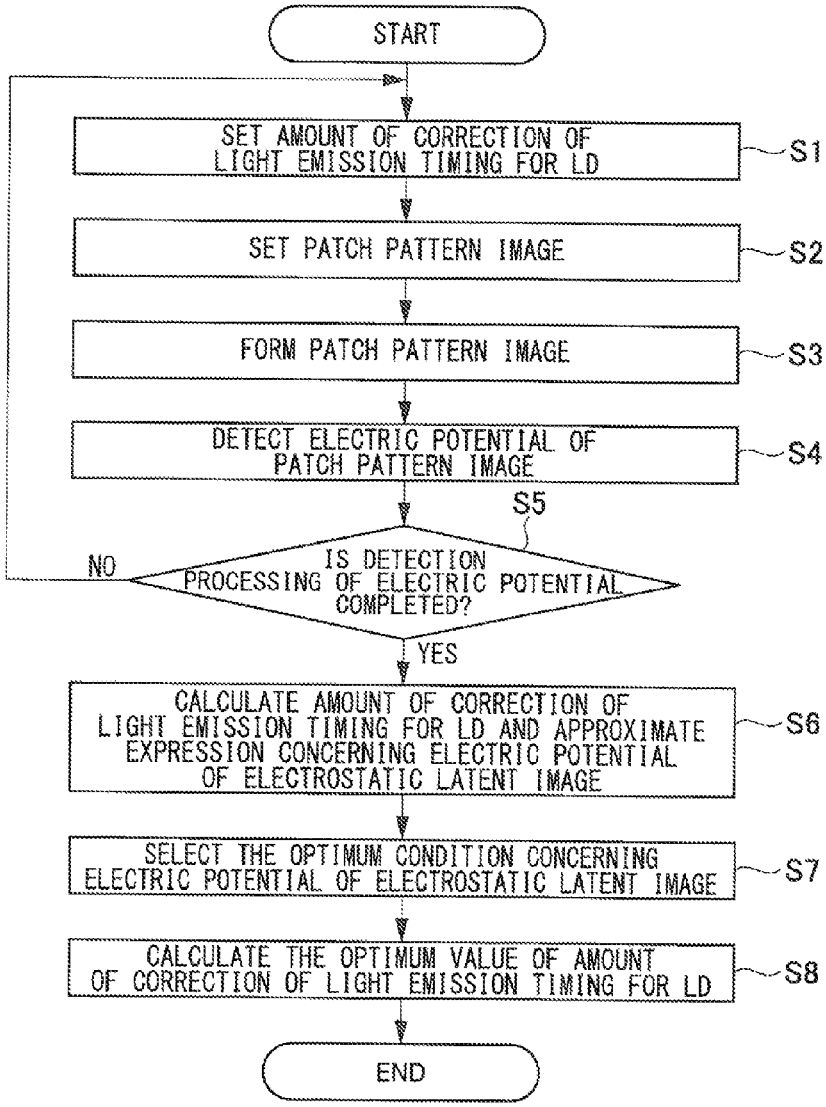
FIG. 6 is a flowchart showing a process of adjusting exposure positions according to the first embodiment.

FIG. 6 is a flowchart showing processes of adjusting exposure positions performed by the image forming apparatus 1. The CPU 101 executes a program stored in the ROM 102, thereby achieving processes shown in FIG. 6. The following processes are performed, for example, before the image forming apparatus is shipped, or when the image forming apparatus breaks down after delivered to a customer.

First, the CPU 101 of the image forming apparatus 1 detects start of a job concerning adjustment of exposure positions, on the basis of operation signals input through the operation displaying section 105 or job information transmitted from the PC 120 through the communication section 108. Once the CPU 101 detects the start of the job concerning the adjustment of exposure positions, the CPU 101 reads the amount of correction of the exposure timing (denoted as "light emission timing" in the drawing) for each of the LDs of the exposure section 43 from the ROM 102 to set it to the RAM 103 (step S1). Such an amount of correction corresponds to the delay time or advance time (the number of steps) from the standard exposure timing, which has been described with reference to FIG. 4. The CPU 101 set, for example, the exposure timing (see the right drawing in FIG. 4) under the first condition to the fifth condition to the LD2.

Next, the CPU 101 reads a patch pattern image PP (see FIG. 4) from the ROM 102, and sets it to the RAM 103 (step S2).

Then, the CPU 101 controls the exposure section 43 (for example, the LD1 and the LD2) of the image forming section 40 on the basis of the patch pattern image PP to form patches 61 to 65 of the patch pattern image PP on the photoreceptor 41 under the first condition to the fifth condition (step S3).

Then, the CPU 101 detects electric potentials of electrostatic latent images in each of the patches 61 to 65 of the patch pattern image PP using the surface potential sensor 46, and stores the detection results in the RAM 103 (step S4).

Then, the CPU 101 determines whether detection of the electric potentials of the electrostatic latent images in each of the patches of the patch pattern image PP is completed for all the conditions (step S5). If the detection of the electric potentials of the electrostatic latent images of the patch pattern image PP is not completed, or if the electric potentials of the electrostatic latent images are detected under other conditions (NO in step S5), the flow returns to step S1. Then, the CPU 101 repeats the processes of steps S1 to S5. On the other hand, if the detection of the electric potentials of the electrostatic latent images of the patch pattern image PP is completed for all the conditions (YES in step S5), the flow moves to step S6.

After the determination process in step S5 is completed, the CPU 101 calculates the amount of correction of the exposure timing for an LD to be measured (for example, the LD2) and an approximate expression (characteristic curve 66) (see FIG. 5) concerning electric potentials of electrostatic latent images (step S6).

Next, the CPU 101 selects the optimum condition on the basis of the approximate expression (characteristic curve 66) (step S7). In the example illustrated in FIG. 5, the optimum condition is the third condition corresponding to the measurement point P3.

Figure 11:
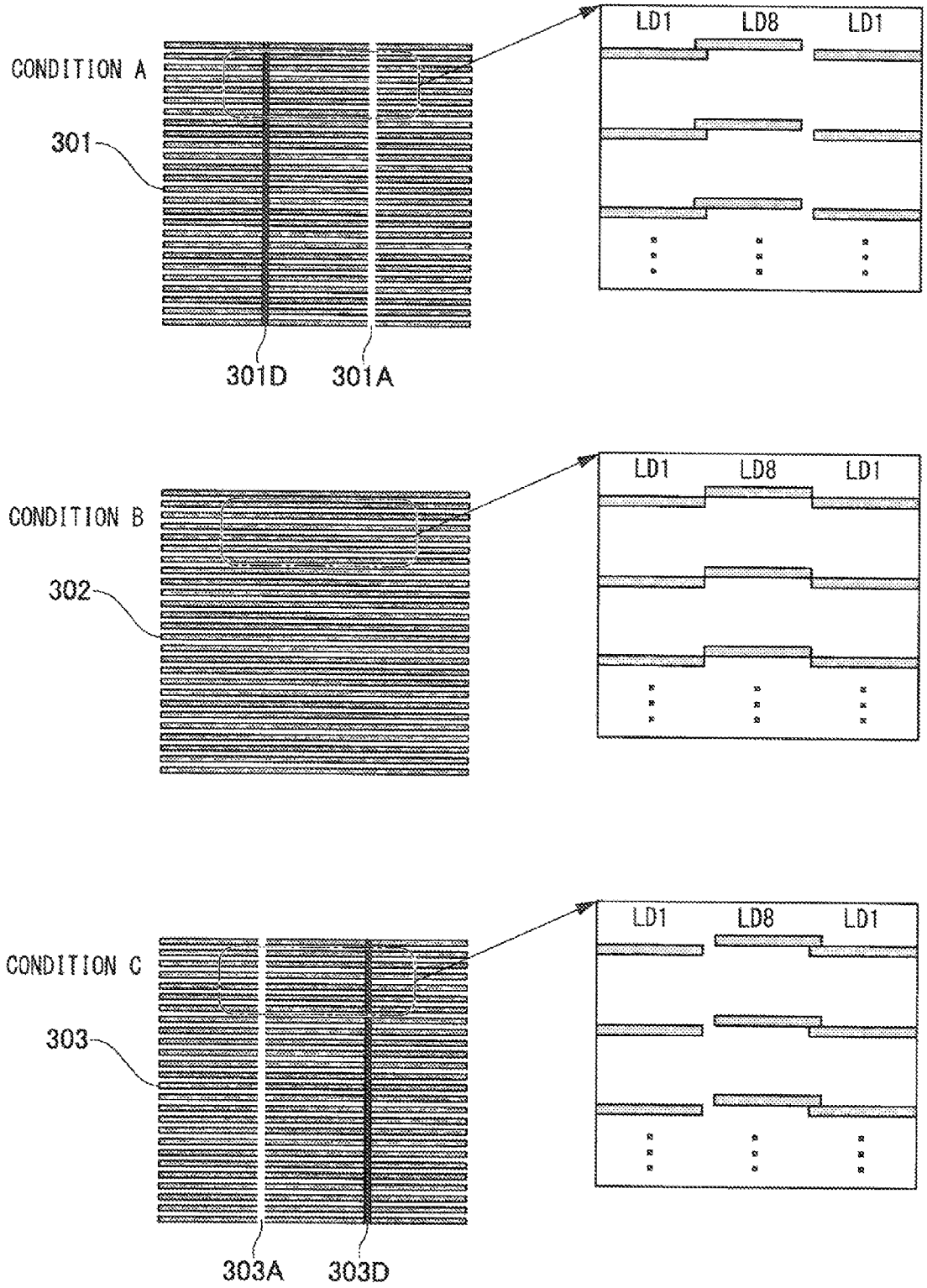
FIG. 11 is an explanatory view illustrating an example of plural line images obtained by exposing plural light beams emitted from plural light sources.
Figure 12A:
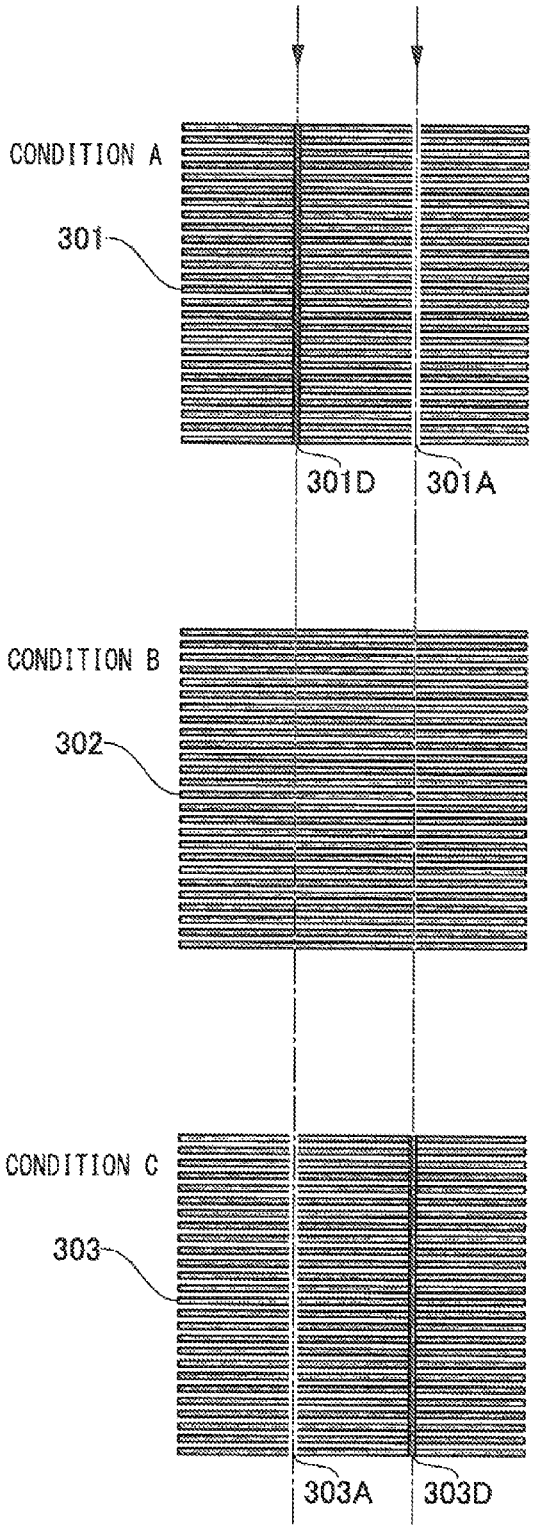
FIGS. 12A and 12B are diagrams explaining problems that a conventional method for adjusting an exposure position has.
Figure 12B:
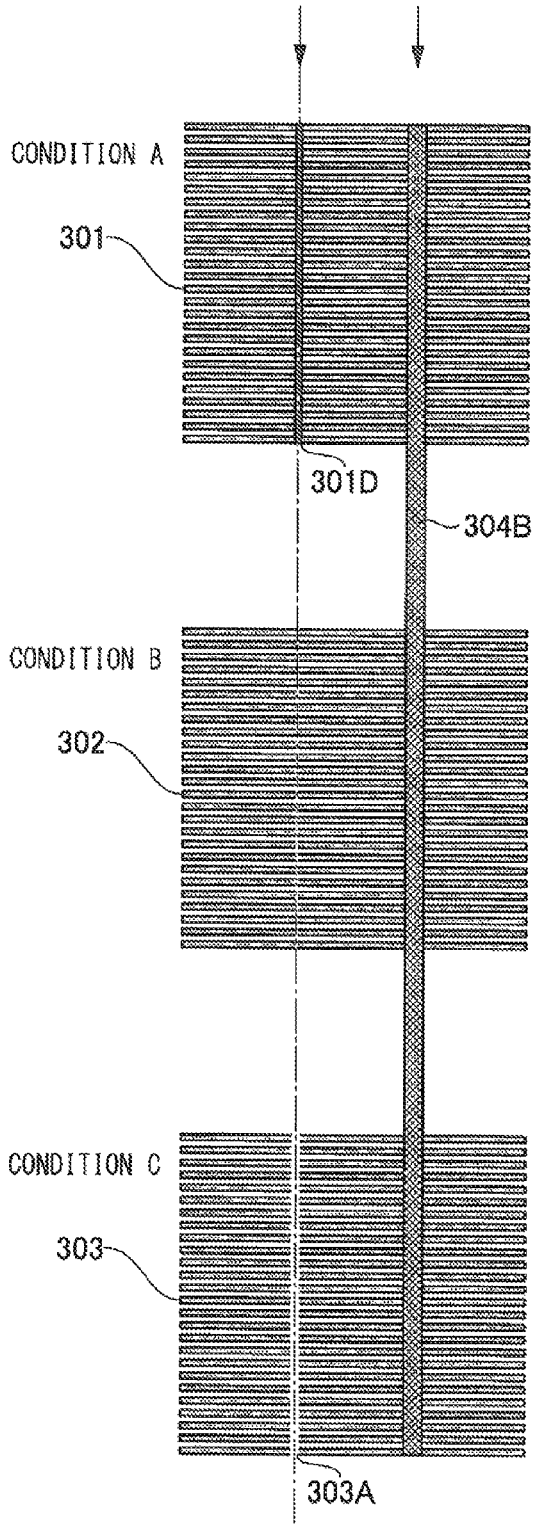

Then, the CPU 101 calculates the optimum value of the amount of correction of the exposure timing for the LD2 on the basis of the optimum condition selected (step S8). In the example illustrated in FIG. 5, the optimum value of the amount of correction is 0 step. The CPU 101 sets the exposure timing for the LD2 to 0 step relative to the LD1 at the time of exposure on the basis of the image data in the subsequent jobs, and then, exposure is performed. It is preferable that the series of processes described above is performed to light sources of which light beams are adjacent to each other, such as the LD1 and the LD2 (see FIG. 3 and FIG. 4), or the LD1 and the LD8 (see FIG. 11).

In the first embodiment described above, exposure timings for plural light beams in the main-scanning direction are adjusted (corrected) on the basis of electric potentials, before development, of electrostatic latent images formed by the plural light beams and formed on the photoreceptor 41 in the main-scanning direction at various exposure timings. Thus, it is possible to appropriately adjust beam pitches in the main-scanning direction with the plural light beams without receiving any effect, for example, of process noises after exposure.

It should be noted that, in the example illustrated in FIG. 6, electric potentials of electrostatic latent images are collectively detected after the patches 61 to 65 of the patch pattern image PP are formed. However, it may be possible to perform the patch formation for each of the patches 61 to 65, and then, detect the electric potentials of the electrostatic latent images every time each of the patches 61 to 65 is formed.

2. Second Embodiment

A second embodiment relates to an exposure position adjusting method, which employs a photo-induced discharge curve (PIDC), and forms plural electrostatic latent images on the surface of the photoreceptor 41 at plural different exposure timings with various gradation levels.

Figure 7:
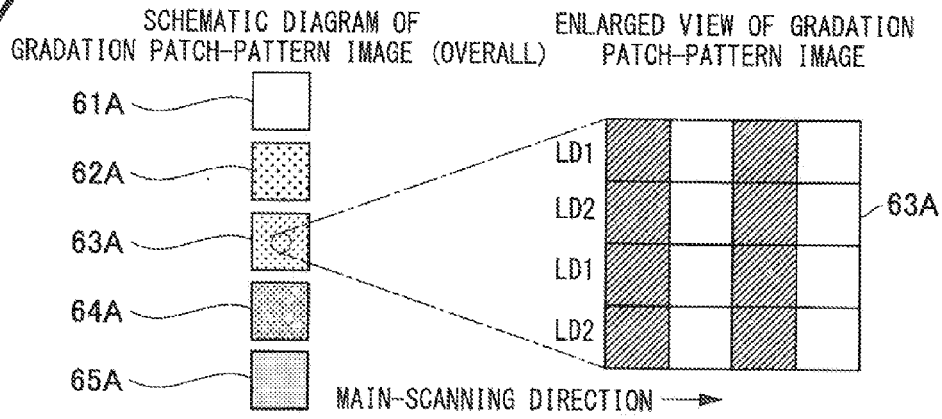
FIG. 7 is an explanatory view illustrating a gradation patch-pattern image according to a second embodiment of the present invention.

FIG. 7 is an explanatory view illustrating a gradation patch-pattern image according to the second embodiment.

As illustrated in the left drawing in FIG. 7, a pattern image for adjusting exposure positions according to the present embodiment has plural patch-like pattern images with different gradations (hereinafter, referred to as "gradation patch-pattern images") formed on the surface of the photoreceptor 41. In the example, five patches 61A to 65A having different gradations are arranged in the sub-scanning direction perpendicular to the main-scanning direction. The gradation patch-pattern image is formed for each of the first to fourth image forming units 40Y, 40M, 40C, and 40K. The right drawing in FIG. 7 is a diagram in which a portion of the gradation patch-pattern image is enlarged. In the gradation patch-pattern image, gradations of each of the patches are different. However, patterns of each of the patches are equal.

Figure 8A:
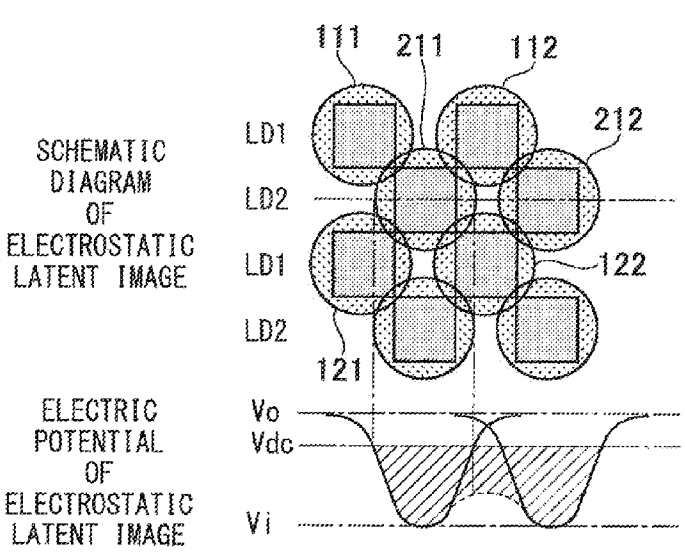
FIGS. 8A, 8B, 8C are explanatory views illustrating an example of positions of electrostatic latent images with a given gradation and electric potentials of the electrostatic latent images according to the second embodiment.
Figure 8B:
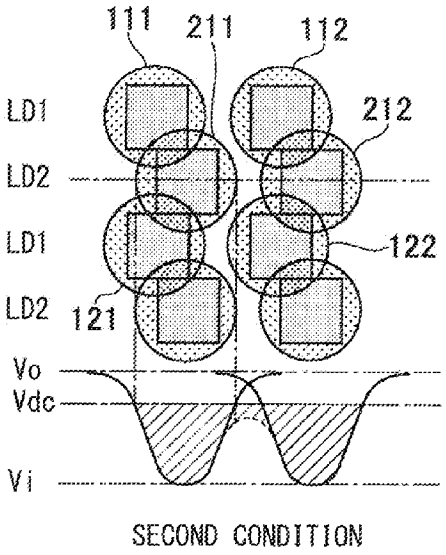
Figure 8C:
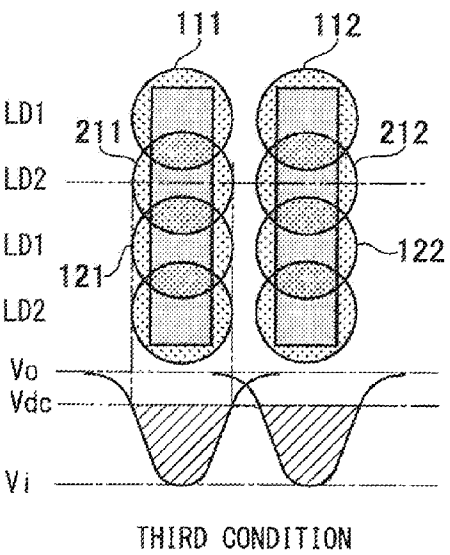

FIGS. 8A, 8B, 8C illustrate an example of positions of electrostatic latent images with a given gradation and electric potentials of the electrostatic latent images according to the second embodiment.

In the present embodiment, plural electrostatic latent images are formed on the surface of the photoreceptor 41 with plural different gradations (gradation patch-pattern image in FIG. 7) at various exposure timings (the first condition to the third condition in FIG. 8A to FIG. 8C). Squares in each of the electrostatic latent images indicate positions where exposure is performed. The exposure timings for the LD1 and the LD2 under the first condition to the third condition illustrated in FIG. 8A to FIG. 8C, respectively, are equal to those under the first condition to the third condition illustrated in FIG. 4. Under the first condition, the distance between electrostatic latent images next to each other in the main-scanning direction is short, and hence, each electric potential is more likely to decrease. On the other hand, under the third condition, the distance between electrostatic latent images next to each other in the main-scanning direction is long, and hence, each electric potential is less likely to decrease. Then, electric potentials of plural electrostatic latent images are acquired from the surface potential sensor 46 for each of the gradations and each of the exposure timings, and an approximate expression (photo-induced discharge curve) indicating a relationship between gradation levels and electric potentials of plural electrostatic latent images is calculated for each of the exposure timings.

Figure 9:
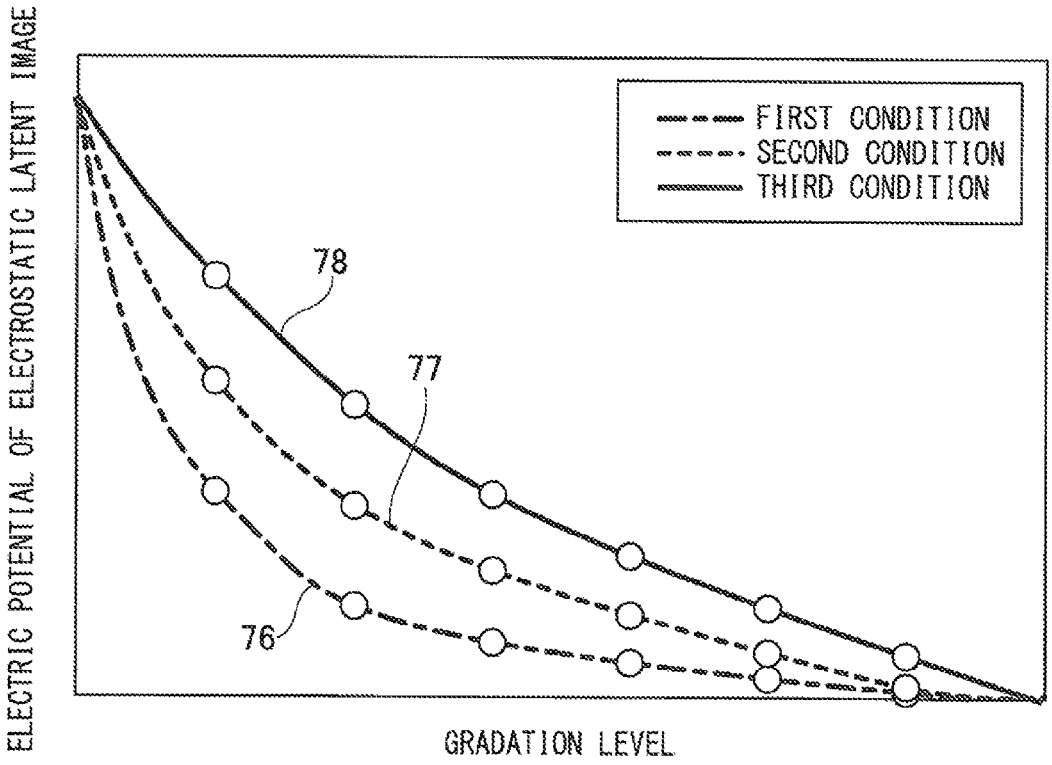
FIG. 9 is a graph showing, for each condition, an example of relationships (photo-induced discharge curves) between gradation levels and electric potentials of electrostatic latent images according to the second embodiment.

FIG. 9 is a graph showing an example of relationships (photo-induced discharge curves) between gradation levels and electric potentials of electrostatic latent images for each condition. The horizontal axis represents gradation levels, and the vertical axis represents electric potentials of electrostatic latent images.

As illustrated in FIG. 9, photo-induced discharge curves 76 to 78 are obtained for each of the conditions (from the first condition to the third condition) of the exposure timings. The condition where the photo-induced discharge curve is the least sensitive (change in gradient of the tangent line to the curve is the smallest) is the optimum condition for the exposure timing. Thus, the CPU 101 determines an exposure timing that satisfies the condition. In the example illustrated in FIG. 9, the photo-induced discharge curve at the time of the third condition (see FIG. 8C) is the optimum condition.

Figure 10:
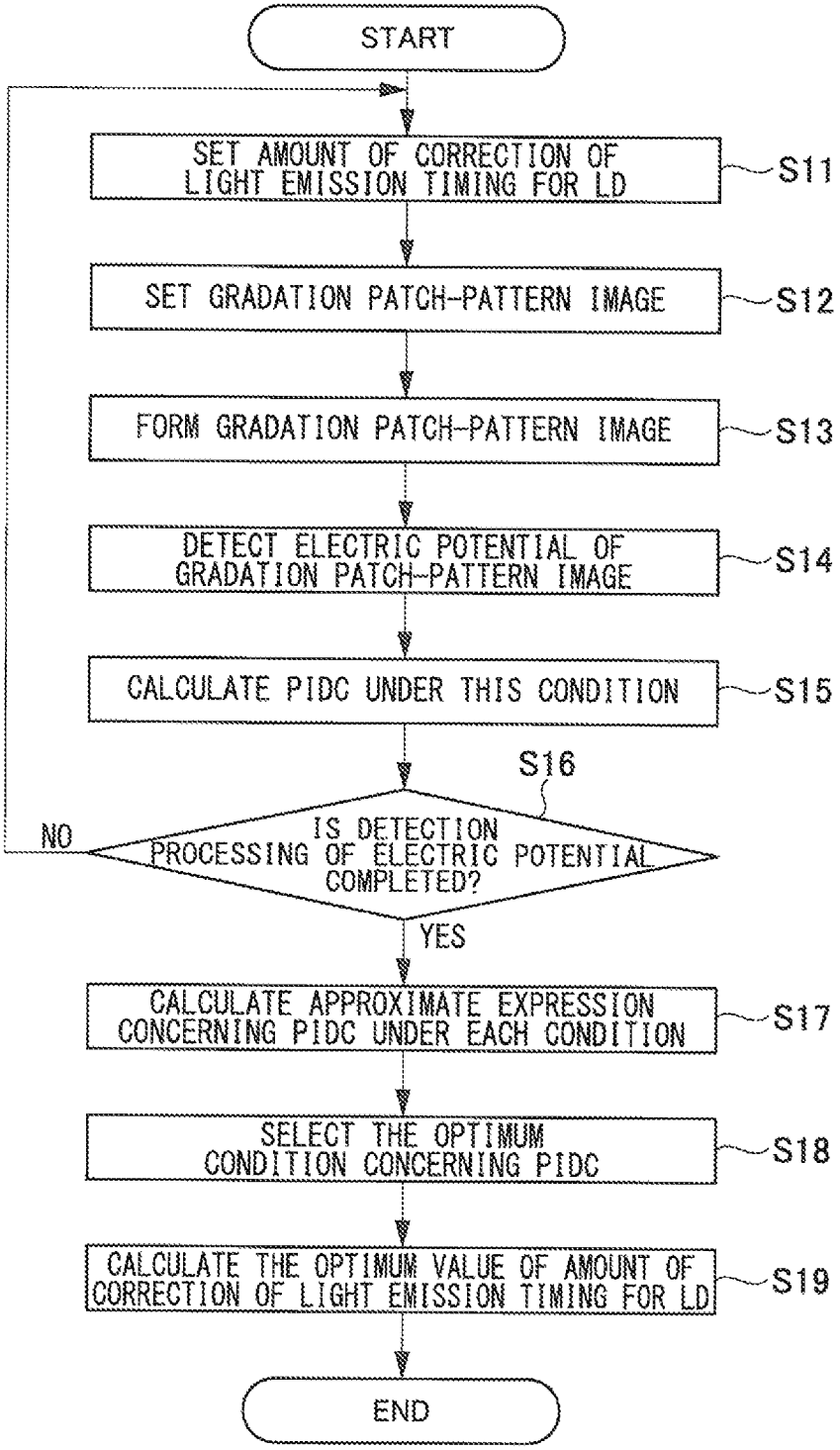
FIG. 10 is a flowchart showing a process of adjusting exposure positions according to the second embodiment.

FIG. 10 is a flowchart showing processes of adjusting exposure positions according to the second embodiment. The CPU 101 executes a program stored in the ROM 102, thereby achieving the processes shown in FIG. 10.

First, the CPU 101 of the image forming apparatus 1 detects start of a job concerning adjustment of exposure positions, and reads, from the ROM 102, the amount of correction of exposure timings (denoted as "light emission timing" in the drawing) for each of the LDs of the exposure section 43 to set it to the RAM 103 (step S11). The CPU 101 sets, to the LD2, the exposure timing of the first condition (see the right drawing in FIG. 8A).

Then, the CPU 101 reads a gradation patch-pattern image (see FIG. 7) from the ROM 102 to set it to the RAM 103 (step S12).

Then, the CPU 101 controls the exposure section 43 (for example, the LD1 and the LD2) of the image forming section 40 on the basis of the gradation patch-pattern image to form patches 61A to 65A of the gradation patch-pattern image on the photoreceptor 41 under the first condition (step S13).

Then, the CPU 101 detects electric potentials of electrostatic latent images in each of the patches 61A to 65A of the gradation patch-pattern image using the surface potential sensor 46, and stores the detection results in the RAM 103 (step S14).

Then, the CPU 101 calculates an approximate expression (photo-induced discharge curve 76) (see FIG. 9) relating to gradation levels and electric potentials of electrostatic latent images concerning an LD to be measured (for example, LD2) in the case of the first condition (step S15).

Then, the CPU 101 determines whether detection of electric potentials of electrostatic latent images in each of the patches of a gradation patch-pattern image is completed for all the conditions (step S16). If detection of the electric potentials of the electrostatic latent images in each of the patches of the gradation patch-pattern image is not completed for all the conditions (NO in step S16), the flow returns to step S11. In the example, detection of the electric potentials of the electrostatic latent images is not completed for the second condition and the third condition, and hence, the CPU 101 repeats processes of steps S11 to S16. On the other hand, if detection of the electric potentials of the electrostatic latent images in each of the patches of the gradation patch-pattern image is completed for all the conditions (YES in step S16), the flow moves to step S17.

After the determination process in step S16 is completed, the CPU 101 acquires approximate expressions (photo-induced discharge curves 76 to 78) (see FIG. 9) relating to gradation levels and electric potentials of electrostatic latent images concerning an LD to be measured (for example, LD2) under each of the conditions (the first condition to the third condition) (step S17).

Next, the CPU 101 selects a photo-induced discharge curve that satisfies the optimum condition on the basis of these approximate expressions (photo-induced discharge curves 76 to 78) (step S18). In the example illustrated in FIG. 9, the optimum condition is the photo-induced discharge curve 78 under the third condition.

Then, the CPU 101 calculates the optimum value of the amount of correction of the exposure timing for the LD2 on the basis of the optimum condition selected (step S19). In the example illustrated in FIGS. 8A-8C and FIG. 9, the optimum value of the amount of correction is 0 step. Furthermore, the CPU 101 sets the exposure timing for the LD2 to 0 step relative to the LD1 at the time of exposure performed on the basis of the image data in the subsequent jobs, and then, exposure is performed. The series of processes described above is performed to light sources of which light beams are adjacent to each other, such as the LD1 and the LD2 (see FIG. 7 and FIGS. 8A-8C), or the LD1 and the LD8 (see FIG. 11).

According to the second embodiment described above, the exposure timing for each of the plural light beams in the main-scanning direction is adjusted (corrected) on the basis of electric potentials, before development, of electrostatic latent images formed on the photoreceptor 41 by the plural light beams in the main-scanning direction for each gradation level at various exposure timings. Thus, it is possible to appropriately adjust beam pitches in the main-scanning direction formed by the plural light beams using the photo-induced discharge curves without receiving any effect, for example, of process noises after exposure.

It should be noted that, in the example illustrated in FIG. 9, for each of the conditions, the patches 61A to 65A of the gradation patch-pattern image are formed, and electric potentials of electrostatic latent images are detected to calculate the photo-induced discharge curves. However, it may be possible to employ a configuration in which, after detection of the electric potentials of the electrostatic latent images is completed for all the conditions, the photo-induced discharge curves are collectively calculated for each of the conditions.

These are descriptions of embodiments to which the invention made by the present inventors are applied. However, the present invention is not limited by statements and drawings that constitute part of disclosure of the present invention through the embodiments described above, and various modifications are possible without departing from the main points of the present invention described in the scope of claims.

In the first and second embodiments described above, an electrophotographic image forming apparatus has been described. However, the present invention can be applied to image forming apparatus other than the electrophotographic image forming apparatus. For example, the present invention can be applied to an image forming apparatus in which plural light beams emitted from plural light sources scan, for example, an image carrier such as a photoreceptor in the main-scanning direction and the sub-scanning direction.

Furthermore, in the first and second embodiments described above, descriptions have been made of an example in which, for example, in FIG. 4 and FIGS. 8A, 8B, 8C, electric potentials of two electrostatic latent images existing adjacent to each other in the main-scanning direction are detected. However, needless to say, electric potentials of three or more electrostatic latent images may be detected to adjust exposure timings.

What is claimed is:

1. An image forming apparatus, comprising:

a photoreceptor;

an exposure section configured to scan a plurality of light beams to form a plurality of electrostatic latent images periodically along a main-scanning direction of the photoreceptor at a predetermined pitch in a sub-scanning direction of the photoreceptor;

a surface potential detecting section configured to detect electric potentials of the plurality of electrostatic latent images formed on the surface of the photoreceptor, along the main-scanning direction; and a controller configured to calculate exposure timings by the plurality of light beams in the exposure section on the basis of a detection result by the surface potential detecting section;

wherein the exposure section forms a plurality of electrostatic latent images on the surface of the photoreceptor at a plurality of different exposure timings, the controller calculates an appropriate exposure timing at which intervals between the plurality of electrostatic latent images periodically formed by one light beam and the plurality of electrostatic latent images periodically formed by the other light beam are aligned in the main-scanning direction, on the basis of electric potentials of the plurality of electrostatic latent images for each of the exposure timings obtained from the surface potential detecting section, the exposure section performs a process of forming a plurality of electrostatic latent images on the surface of the photoreceptor with a plurality of gradations on the basis of a patch pattern image including patches having different gradations, while changing the exposure timing, and the controller acquires, from the surface potential detecting section, electric potentials of the plurality of electrostatic latent images for each of the gradations and each of the exposure timings; calculates an approximate expression indicating a relationship between the gradation and the integral value of electric potentials of the plurality of electrostatic latent images for each of the exposure timings; and calculates an exposure timing corresponding to a curve having the smallest change in gradient of a tangent line of the curve among curves expressed by the respective approximate expressions, as the optimum exposure timing.

2. An exposure position adjusting method, comprising the processes of:

scanning, by an exposure section, a plurality of light beams to form a plurality of electrostatic latent images periodically along a main-scanning direction of a photoreceptor at a predetermined pitch in a sub-scanning direction of the photoreceptor;

detecting, by a surface potential detecting section, electric potentials of the plurality of electrostatic latent images formed on the surface of the photoreceptor, along the main-scanning direction; and calculating, by a controller, exposure timings by the plurality of light beams in the exposure section on the basis of a detection result by the surface potential detecting section;

wherein the exposure section forms a plurality of electrostatic latent images on the surface of the photoreceptor at a plurality of different exposure timings, the controller calculates an appropriate exposure timing at which intervals between the plurality of electrostatic latent images periodically formed by one light beam and the plurality of electrostatic latent images periodically formed by the other light beam are aligned in the main-scanning direction, on the basis of electric potentials of the plurality of electrostatic latent images for each of the exposure timings obtained from the surface potential detecting section, the exposure section performs a process of forming a plurality of electrostatic latent images on the surface of the photoreceptor with a plurality of gradations on the basis of a patch pattern image including patches having different gradations, while changing the exposure timing, and the controller acquires, from the surface potential detecting section, electric potentials of the plurality of electrostatic latent images for each of the gradations and each of the exposure timings; calculates an approximate expression indicating a relationship between the gradation and the integral value of electric potentials of the plurality of electrostatic latent images for each of the exposure timings; and calculates an exposure timing corresponding to a curve having the smallest change in gradient of a tangent line of the curve among curves expressed by the respective approximate expressions, as the optimum exposure timing.

* * * * *